US006012552A

United States Patent [19]

Del Rio

[11] Patent Number: 6,012,552

[45] Date of Patent: Jan. 11, 2000

[54] GROCERY LIFT

[76] Inventor: Ron Del Rio, 33495 Huggins Avenue, Abbotsford, Canada, V2S 2S1

[21] Appl. No.: 09/182,737

[22] Filed: Oct. 29, 1998

[51] Int. Cl.[7] ..... B66B 11/08

[52] U.S. Cl. ..... 187/264; 187/262; 187/401; 187/406

[58] Field of Search ..... 187/201, 220, 187/262, 401, 406, 239, 245

[56] References Cited

U.S. PATENT DOCUMENTS

| | | | |
|---|---|---|---|
| 387,512 | 8/1888 | Haines | 187/262 X |
| 665,707 | 1/1901 | Tromanhauser | 187/262 X |
| 2,531,346 | 11/1950 | Schuchert | 187/239 |
| 2,950,948 | 8/1960 | Hardigan et al. | 187/262 X |
| 3,223,199 | 12/1965 | Schwehr | 187/262 |
| 3,368,704 | 2/1968 | Pope | 187/239 X |
| 3,500,963 | 3/1970 | Beutler | 187/201 X |
| 3,749,202 | 7/1973 | Puls | 187/201 |
| 4,071,115 | 1/1978 | Garcia | 187/262 X |

*Primary Examiner*—Robert P. Olszewski
*Assistant Examiner*—Steven B. McAllister

[57] ABSTRACT

A grocery lift for lifting and lowering grocery loads. The apparatus includes a pair of spaced apart elongate guide rails with a support chassis interposed between the guide rails. The support chassis is mounted to each of the guide rails to permit riding of the support chassis along the guide rails between the top and bottom ends of the guide rails. An upper pulley is provided and is adapted for mounting to the support structure between the guide rails. A winch is provided adjacent the bottom ends of the guide rails. A flexible elongate member is looped around the upper pulley with one end of the flexible elongate member coupled to the support chassis and another end of the flexible elongate member coupled to the winch to permit winding and unwinding of the flexible elongate member about the winch. A support platform is pivotally coupled to the front surface of the support chassis.

8 Claims, 2 Drawing Sheets

10
11
13
14
30
29
33
21
25
27
18
19
23
20
41
38
35
34
37
28
22
36
39
32
29
31
33
15

23
29
21
18
11
29
14
32
20
26
12
13
17
16
25
19
24
38
42
41
35
39
37
40
34

27
13
34
18
41
28

GROCERY LIFT

BACKGROUND OF THE INVENTION

1. Field of the Invention

The present invention relates to devices for lifting and lowering grocery loads and more particularly pertains to a new grocery lift for lifting and lowering grocery loads.

2. Description of the Prior Art

The use of devices for lifting and lowering grocery loads is known in the prior art. More specifically, devices for lifting and lowering grocery loads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,078,634; U.S. Pat. No. 3,908,801; U.S. Pat. No. 4,664,230; U.S. Pat. No. 4,938,310; U.S. Pat. No. Des. 248,777; and U.S. Pat. No. 3,880,258.

While these devices fulfill their respective, particular objectives and requirements, the aforementioned patents do not disclose a new grocery lift. The inventive device includes a pair of spaced apart elongate guide rails with a support chassis interposed between the guide rails. The support chassis is mounted to each of the guide rails to permit riding of the support chassis along the guide rails between the top and bottom ends of the guide rails. An upper pulley is provided and is adapted for mounting to the support structure between the guide rails. A winch is provided adjacent the bottom ends of the guide rails. A flexible elongate member is looped around the upper pulley with one end of the flexible elongate member coupled to the support chassis and another end of the flexible elongate member coupled to the winch to permit winding and unwinding of the flexible elongate member about the winch. A support platform is pivotally coupled to the front surface of the support chassis.

In these respects, the grocery lift according to the present invention substantially departs from the conventional concepts and designs of the prior art, and in so doing provides an apparatus primarily developed for the purpose of lifting and lowering grocery loads.

SUMMARY OF THE INVENTION

In view of the foregoing disadvantages inherent in the known types of devices for lifting and lowering grocery loads now present in the prior art, the present invention provides a new grocery lift construction wherein the same can be utilized for lifting and lowering grocery loads.

The general purpose of the present invention, which will be described subsequently in greater detail, is to provide a new grocery lift apparatus and method which has many of the advantages of the devices for lifting and lowering grocery loads mentioned heretofore and many novel features that result in a new grocery lift which is not anticipated, rendered obvious, suggested, or even implied by any of the prior art devices for lifting and lowering grocery loads, either alone or in any combination thereof.

To attain this, the present invention generally comprises a pair of spaced apart elongate guide rails with a support chassis interposed between the guide rails. The support chassis is mounted to each of the guide rails to permit riding of the support chassis along the guide rails between the top and bottom ends of the guide rails. An upper pulley is provided and is adapted for mounting to the support structure between the guide rails. A winch is provided adjacent the bottom ends of the guide rails. A flexible elongate member is looped around the upper pulley with one end of the flexible elongate member coupled to the support chassis and another end of the flexible elongate member coupled to the winch to permit winding and unwinding of the flexible elongate member about the winch. A support platform is pivotally coupled to the front surface of the support chassis.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grocery lift apparatus and method which has many of the advantages of the devices for lifting and lowering grocery loads mentioned heretofore and many novel features that result in a new grocery lift which is not anticipated, rendered obvious, suggested, or even implied by any of the prior art devices for lifting and lowering grocery loads, either alone or in any combination thereof.

It is another object of the present invention to provide a new grocery lift which may be easily and efficiently manufactured and marketed.

It is a further object of the present invention to provide a new grocery lift which is of a durable and reliable construction.

An even further object of the present invention is to provide a new grocery lift which is susceptible of a low cost of manufacture with regard to both materials and labor, and which accordingly is then susceptible of low prices of sale to the consuming public, thereby making such grocery lift economically available to the buying public.

Still yet another object of the present invention is to provide a new grocery lift which provides in the apparatuses and methods of the prior art some of the advantages thereof, while simultaneously overcoming some of the disadvantages normally associated therewith.

Still another object of the present invention is to provide a new grocery lift for lifting and lowering grocery loads.

Yet another object of the present invention is to provide a new grocery lift which includes a pair of spaced apart elongate guide rails with a support chassis interposed between the guide rails. The support chassis is mounted to each of the guide rails to permit riding of the support chassis along the guide rails between the top and bottom ends of the guide rails. An upper pulley is provided and is adapted for mounting to the support structure between the guide rails. A winch is provided adjacent the bottom ends of the guide rails. A flexible elongate member is looped around the upper pulley with one end of the flexible elongate member coupled to the support chassis and another end of the flexible elongate member coupled to the winch to permit winding and unwinding of the flexible elongate member about the winch. A support platform is pivotally coupled to the front surface of the support chassis.

Still yet another object of the present invention is to provide a new grocery lift that may be mounted to a generally vertical structure such as a wall to lift groceries from a lower level such as a first floor of a dwelling to a higher level such as a second floor of the dwelling so that a user does not have to carry their groceries up a flight or more of stairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
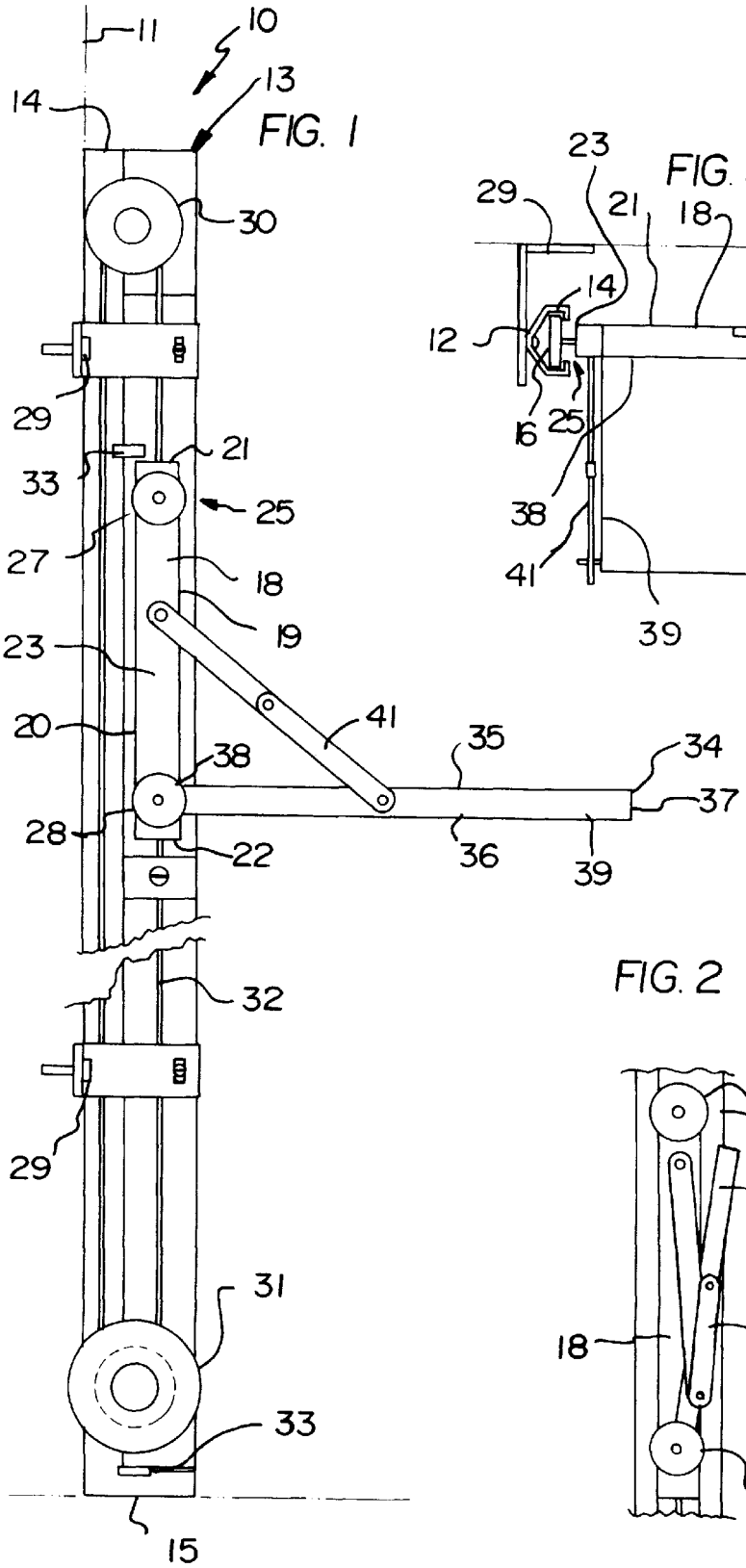
FIG. 1 is a schematic side view of a new grocery lift according to the present invention.
Figure 3:
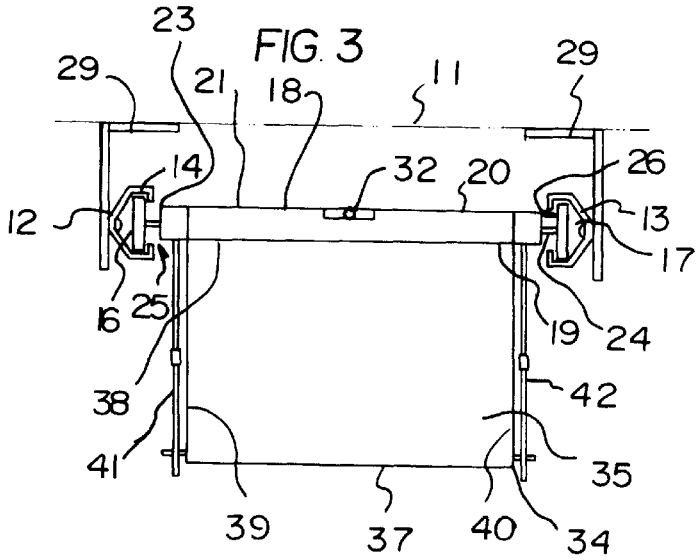
FIG. 3 is a schematic top end view of the present invention.

With reference now to the drawings, and in particular to FIGS. 1 through 4 thereof, a new grocery lift embodying the principles and concepts of the present invention and generally designated by the reference numeral 10 will be described.

As best illustrated in FIGS. 1 through 4, the grocery lift 10 generally comprises a pair of spaced apart elongate guide rails 12,13 with a support chassis 18 interposed between the guide rails 12,13. The support chassis 18 is mounted to each of the guide rails 12,13 to permit riding of the support chassis 18 along the guide rails 12,13 between the top and bottom ends 14,15 of the guide rails 12,13. An upper pulley 30 is provided and is adapted for mounting to the support structure 11 between the guide rails 12,13. A winch 31 is provided adjacent the bottom ends 15 of the guide rails 12,13. A flexible elongate member 32 is looped around the upper pulley 30 with one end of the flexible elongate member 32 coupled to the support chassis 18 and another end of the flexible elongate member 32 coupled to the winch 31 to permit winding and unwinding of the flexible elongate member 32 about the winch 31. A support platform 34 is pivotally coupled to the front surface 19 of the support chassis 18.

In use, the lift apparatus 10 is designed for lifting objects such as groceries from a lower level to a higher level on a structure 11. Specifically, the lift apparatus 10 comprises a pair of spaced apart elongate guide rails 12,13 each having top and bottom ends 14,15, and a longitudinal axis extending between the top and bottom ends 14,15. The guide rails 12,13 are adapted for mounting to a generally vertical support structure 11 such as a wall structure 11 by brackets and fasteners 29. The longitudinal axes of the guide rails 12,13 are preferably extended generally parallel to one another and generally vertical to a ground surface. In an ideal setup, the bottom ends 15 of the guide rails 12,13 are positionable on the lower level of the structure 11 and the top ends 14 of the guide rails 12,13 are positionable on the upper level of the structure 11. Each of the guide rails 12,13 has an elongate guide channel 16,17 extending between the top and bottom ends 14,15 of the respective guide rail. The guide channels 16,17 of the guide rails 12,13 face towards one another.

Each of the guide channels has a front portion, a rear portion, a pair of flanges and an angled back portion. One of the flanges is inwardly extending from an end of the front portion and the other of the flanges is inwardly extending from an end of the rear portion such that the flanges have a gap therebetween. The back portion of the guide rail is coupled to the front portion and the rear portion such that a pair of angled walls extend away from the flanges.

A support chassis 18 is interposed between the guide rails 12,13. The support chassis 18 is generally rectangular and has generally rectangular and generally flat front and back surfaces 19,20, generally straight upper and lower ends 21,22, and a pair of lateral sides 23,24 extending between the upper and lower ends 21,22 of the support chassis 18. The support chassis 18 is mounted to each of the guide rails 12,13 to permit riding that is movement of the support chassis 18 along the guide rails 12,13 between the top and bottom ends 14,15 of the guide rails 12,13 so that the support chassis may be raised and lowered. One of the lateral sides of the support chassis is mounted to one of the guide rails and another of the lateral sides of the support chassis is mounted to another of the guide rails. The front and back surfaces 19,20 of said support chassis 18 preferably lie in generally vertical planes generally parallel to the longitudinal axes of the guide rails 12,13.

Each of the lateral sides 23,24 of the support chassis 18 has a roller assembly 25,26 comprising a pair of rotatably mounted wheels 27,28 extending into the guide channel 16,17 of the adjacent associated guide rail. One of the wheels of each of the roller assemblies is preferably positioned adjacent the upper end 21 of the support chassis 18 and another of the wheels of each of the roller assemblies is preferably positioned adjacent the lower end 22 of the support chassis 18. In use, the wheels 27,28 of the roller assemblies rolling along the length of the guide channel 16,17 of the associated guide rail when the support channel moves along the length of the guide rails 12,13.

An upper pulley 30 is provided and is adapted for mounting to the support structure 11 between the guide rails 12,13 so that the upper pulley 30 is positioned adjacent or above the top ends 14 of the guide rails 12,13. A winch 31 is provided adjacent the bottom ends 15 of the guide rails 12,13. Preferably, the winch 31 is positioned between the guide rails 12,13 and generally beneath the upper pulley 30. A flexible elongate member 32 such as a cable, a rope, or a chain is looped around the upper pulley 30. One of a pair of opposite ends of the flexible elongate member 32 is coupled to the upper end 21 of the support chassis 18 while the other end of the flexible elongate member 32 is coupled to the winch 31 to permit winding and unwinding of the flexible elongate member 32 about the winch 31. In use, winding the flexible elongate member 32 about the winch 31 moves the support chassis 18 in a direction from the bottom ends 15 of the guide rails 12,13 towards the top ends 14 of the guide rails 12,13 such that the support chassis 18 is raised in elevation with respect to the bottom ends 15 of the guide rails 12,13. Unwinding the flexible elongate member 32 from about the winch 31 moves the support chassis 18 in a direction from the top ends 14 of the guide rails 12,13 towards the bottom ends 15 of the guide rails 12,13 such that the support chassis 18 is lowered in elevation with respect to the bottom ends 15 of the guide rails 12,13. Ideally, the winch 31 has a motor for winding and unwinding the flexible elongate member 32 about the winch 31. The motor has a controller 33 such as lower limit switch for selectively controlling winding and unwinding of the flexible elongate member 32 about the winch 31. Optionally, the winch 31 may have a handle for manually winding and unwinding the flexible elongate member 32 about the winch 31 instead of the motor.

Figure 2:
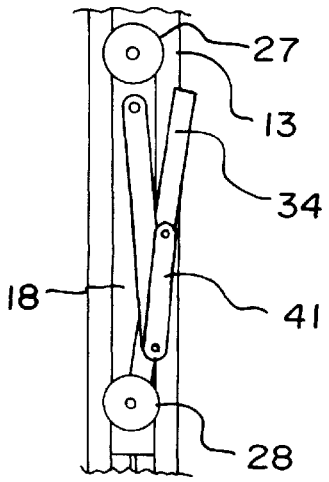
FIG. 2 is a schematic partial side view of the present invention illustrating the raised position of the support platform.
Figure 4:
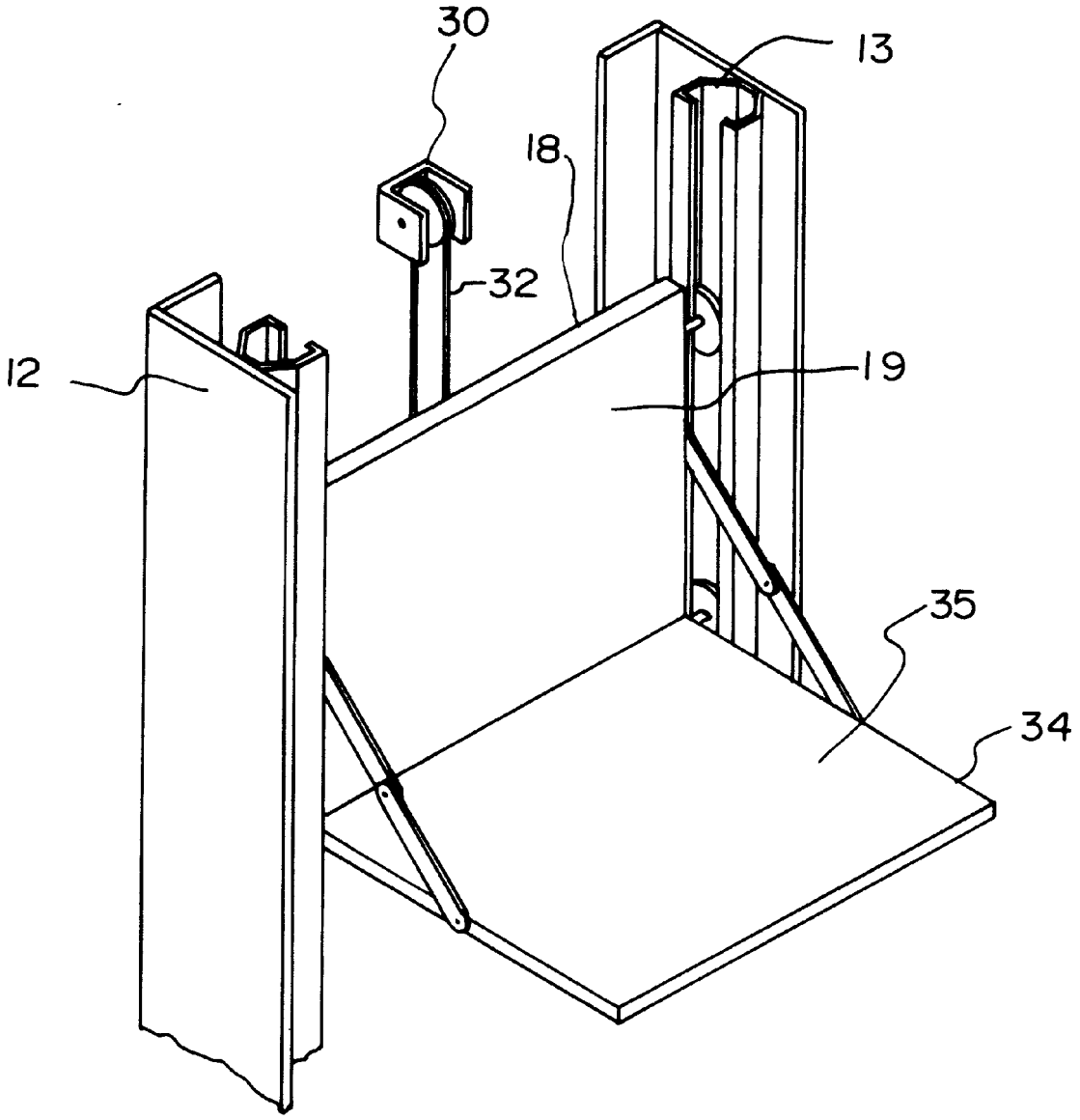
FIG. 4 is a schematic partial perspective view of the top end of the present invention.

The support platform 34 is generally rectangular and has generally rectangular and generally flat top and bottom surfaces 35,36, and generally straight front and back end edges 37,38, and a pair of generally straight side edges 39,40 extending between front and back end edges 37,38 of the support platform 34. The back end edge 38 of the support platform 34 is pivotally coupled to the front surface 19 of the support chassis 18 preferably by a pair of hinge assemblies provided on either lateral side 23,24 of the support chassis 18. In use, the support platform 34 is pivotable between a raised position and a lowered or deployed position. As illustrated in FIG. 1, the top and bottom surfaces 35,36 of the support platform 34 lie in generally horizontal planes when the support platform 34 is in the lower position. As illustrated in FIG. 2, the top and bottom surfaces 35,36 of the support platform 34 lie in vertical planes generally parallel to the planes of the front and back surfaces 19,20 of the support chassis 18 when the support platform 34 is in the raised position.

A pair of scissors support arms 41,42 extend between the support chassis 18 and the support platform 34 to provide additional structural support when the support platform 34 is in the lowered position. One scissors support arm couples one of the lateral sides of the support chassis to one of the side edges of the support platform while another scissors support arm couples another of the lateral sides of the support chassis to another of the side edges of the support platform.

Preferably, the length of each of the guide rails 12,13 defined between the top and bottom ends 14,15 of the respective guide rail is at least 4 feet. In an ideal illustrative embodiment, the lengths of the guide rails are both more than 8 feet. In this ideal illustrative embodiment, the support platform 34 has a width defined between the side edges 39,40 of the support platform 34 of between about 50 cm and about 60 cm and a length defined between the front and back end edges 37,38 of the support platform 34 of about 50 cm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lift apparatus for lifting objects such as groceries from a lower level to a higher level on a structure, said lift apparatus comprising:

a pair of spaced apart elongate guide rails each having top and bottom ends, and a longitudinal axis extending between said top and bottom ends of the respective guide rail, said guide rails being adapted for mounting to a support structure;

a support chassis being interposed between said guide rails;

said support chassis being mounted to each of said guide rails to permit riding of said support chassis along said guide rails between said top and bottom ends of said guide rails;

an upper pulley being adapted for mounting to the support structure between said guide rails;

a winch being provided adjacent said bottom ends of said guide rails;

a flexible elongate member having a pair of opposite ends, said flexible elongate member being looped around said upper pulley, one of said ends of said flexible elongate member being coupled to said support chassis, another end of said flexible elongate member being coupled to said winch to permit winding and unwinding of said flexible elongate member about said winch;

a support platform being pivotally coupled to said front surface of said support chassis;

each of said guide rails having an elongate guide channel extending between said top and bottom ends of the respective guide rail, said guide channels of said guide rails facing towards one another, wherein said support chassis having a roller assembly extending into the guide channel of the adjacent associated guide rail; and each of said guide channels having a front portion, a rear portion, a pair of flanges and an angled back portion, one of said flanges being inwardly extending from an end of said front portion, the other of said flanges inwardly extending from an end of said rear portion such that said pair of flanges have a gap therebetween, said back portion of said guide rail being coupled to said front portion and said rear portion such that a pair of angled walls extend away from said flanges.

2. The lift apparatus of claim 1, wherein said longitudinal axes of said guide rails are extended generally parallel to one another.

3. The lift apparatus of claim 1, wherein said support chassis has front and back surfaces, upper and lower ends, and a pair of lateral sides extending between said upper and lower ends of said support chassis, one of said lateral sides of said support chassis being mounted to one of said guide rails, and another of said lateral sides of said support chassis being mounted to another of said guide rails.

4. The lift apparatus of claim 1, wherein winding said flexible elongate member about said winch moves said support chassis in a direction from said bottom ends of said guide rails towards said top ends of said guide rails such that said support chassis is raised in elevation with respect to said bottom ends of said guide rails, and wherein unwinding said flexible elongate member from about said winch moves said support chassis in a direction from said top ends of said guide rails towards said bottom ends of said guide rails such that said support chassis is lowered in elevation with respect to said bottom ends of said guide rails.

5. The lift apparatus of claim 1, wherein said winch has a handle for winding and unwinding said flexible elongate member about said winch.

6. The lift apparatus of claim 1, wherein said winch has a motor for winding and unwinding said flexible elongate member about said winch.

7. The lift apparatus of claim 6, wherein said motor has a controller for selectively controlling winding and unwinding of said flexible elongate member about said winch.

8. A lift apparatus for lifting objects such as groceries from a lower level to a higher level on a structure, said lift apparatus comprising:

a pair of spaced apart elongate guide rails each having top and bottom ends, and a longitudinal axis extending between said top and bottom ends of the respective guide rail, said guide rails being adapted for mounting to a generally vertical support structure;

said longitudinal axes of said guide rails being extended generally parallel to one another and generally vertical to a ground surface;

each of said guide rails having an elongate guide channel extending between said top and bottom ends of the respective guide rail, said guide channels of said guide rails facing towards one another;

a support chassis being interposed between said guide rails, said support chassis being generally rectangular and having generally rectangular and generally flat front and back surfaces, generally straight upper and lower ends, and a pair of lateral sides extending between said upper and lower ends of said support chassis;

said support chassis being mounted to each of said guide rails to permit riding of said support chassis along said guide rails between said top and bottom ends of said guide rails, one of said lateral side of said support chassis being mounted to one of said guide rails, another of said lateral sides of said support chassis being mounted to another of said guide rails;

said front and back surfaces of sad support chassis lying in planes generally parallel to said longitudinal axes of said guide rails;

each of said lateral sides of said support chassis having a roller assembly comprising a pair of rotatably mounted wheels extending into the guide channel of the adjacent associated guide rail, one of said wheels of each of said roller assemblies being positioned adjacent said upper end of said support chassis, another of said wheels of each of said roller assemblies being positioned adjacent said lower end of said support chassis;

each of said guide channels having a front portion, a rear portion, a pair of flanges and an angled back portion, one of said flanges being inwardly extending from an end of said front portion, the other of said flanges inwardly extending from an end of said rear portion such that said pair of flanges have a gap therebetween, said back portion of said guide rail being coupled to said front portion and said rear portion such that a pair of angled walls extend away from said flanges;

an upper pulley being adapted for mounting to the support structure between said guide rails, said upper pulley being positioned adjacent said top ends of said guide rails;

a winch being provided adjacent said bottom ends of said guide rails, said winch being positioned between said guide rails and generally beneath said upper pulley;

a flexible elongate member having a pair of opposite ends, said flexible elongate member being looped around said upper pulley, one of said ends of said flexible elongate member being coupled to said upper end of said support chassis, another end of said flexible elongate member being coupled to said winch to permit winding and unwinding of said flexible elongate member about said winch;

wherein winding said flexible elongate member about said winch moves said support chassis in a direction from said bottom ends of said guide rails towards said top ends of said guide rails such that said support chassis is raised in elevation with respect to said bottom ends of said guide rails;

wherein unwinding said flexible elongate member from about said winch moves said support chassis in a direction from said top ends of said guide rails towards said bottom ends of said guide rails such that said support chassis is lowered in elevation with respect to said bottom ends of said guide rails;

wherein said winch has a motor for winding and unwinding said flexible elongate member about said winch;

said motor having a controller for selectively controlling winding and unwinding of said flexible elongate member about said winch;

a support platform being generally rectangular and having generally rectangular and generally flat top and bottom surface, and generally straight front and back end edges, and a pair of generally straight side edges extending between front and back end edges of said support platform;

said back end edge of said support platform being pivotally coupled to said front surface of said support chassis;

said support platform being pivotable between a raised position and a lowered position, said top and bottom surfaces of said support platform lying in generally horizontal planes when said support platform is in said lower position, said top and bottom surfaces of said support platform lying in planes generally parallel to said planes of said front and back surfaces of said support chassis when said support platform is in said raised position; and a pair of scissors support arms extending between said support chassis and said support platform to provide additional support when said support platform is in said lowered position, one scissors support arm coupling one of said lateral sides of said support chassis to one of said side edges of said support platform, another scissors support arm coupling another of said lateral sides of said support chassis to another of said side edges of said support platform.

* * * * *